US007066185B2

(12) United States Patent
Hildebrandt

(10) Patent No.: US 7,066,185 B2
(45) Date of Patent: Jun. 27, 2006

(54) HAIR CLIP AND METHOD FOR USING SAID HAIR CLIP

(75) Inventor: Bodo Hildebrandt, Riedstadt (DE)

(73) Assignee: Wella AG, Darmstadt (DE)

( * ) Notice: Subject to any disclaimer, the term of this patent is extended or adjusted under 35 U.S.C. 154(b) by 409 days.

(21) Appl. No.: 10/332,341

(22) PCT Filed: Oct. 31, 2001

(86) PCT No.: PCT/EP01/12597

§ 371 (c)(1),
(2), (4) Date: Jan. 8, 2003

(87) PCT Pub. No.: WO02/35961

PCT Pub. Date: May 10, 2002

(65) Prior Publication Data

US 2003/0098035 A1 May 29, 2003

(30) Foreign Application Priority Data

Oct. 31, 2000 (DE) ..... 100 53 923

(51) Int. Cl.
*A45D 8/20* (2006.01)
*A45D 7/00* (2006.01)
*A41F 1/08* (2006.01)

(52) U.S. Cl. ..... 132/210; 132/277; 24/510

(58) Field of Classification Search ..... 132/251, 132/252, 210, 277, 249, 259, 260, 275, 276, 132/278, 279; 24/557, 508, 510, 499, 500, 24/565, 485; D28/26, 27, 40
See application file for complete search history.

(56) References Cited

U.S. PATENT DOCUMENTS

| | | | | | |
|---|---|---|---|---|---|
| 2,145,539 | A | * | 1/1939 | Bottorf | 132/228 |
| 2,209,318 | A | * | 7/1940 | Caldwell | 24/562 |
| 2,457,898 | A | * | 1/1949 | Hummel | 220/759 |
| D158,343 | S | * | 4/1950 | Watson | D28/40 |
| 2,553,070 | A | * | 5/1951 | Van Megroot | 602/22 |
| 2,579,204 | A | * | 12/1951 | Renstrom | 132/122 |
| 3,358,698 | A | * | 12/1967 | Blanchard | 132/252 |
| 3,653,392 | A | * | 4/1972 | Hassey et al. | 132/252 |
| 4,508,124 | A | | 4/1985 | Franzino | |
| 4,533,328 | A | * | 8/1985 | McDaniel | 434/94 |
| 4,624,272 | A | * | 11/1986 | Franzino | 132/251 |

(Continued)

FOREIGN PATENT DOCUMENTS

BE 494 627 A 7/1950

(Continued)

*Primary Examiner*—Kevin Shaver
*Assistant Examiner*—Stephanie L Willatt
(74) *Attorney, Agent, or Firm*—Michael J. Striker

(57) ABSTRACT

The hairclip (1) has two legs (4, 5) and a hinge (6) with a spring (7) connecting the legs. The legs (4, 5) each have a tine base (10, 11) and a number of curved tines (8, 9) arranged in rows on one side of it. Each tine base (10, 11) is adjoined by an actuating section (12, 13) on the opposite side. The two actuating-sections (12, 13) are disposed asymmetrically relative to a length of the tine bases (10, 11) and opposite each other. For the sake of tight spacing and easy manipulation, these hairclips (1) are placed on the curlers (2) in such a way that the actuating leg sections (12, 13) of one hairclip (1) are not disposed in the immediate vicinity of the actuating leg sections (12, 13) of an adjacent hairclip (1).

9 Claims, 3 Drawing Sheets

U.S. PATENT DOCUMENTS 4,898,194 A 2/1990 Einspahr
5,365,953 A * 11/1994 Feughelman ..... 132/231
5,842,485 A 12/1998 Potut
5,865,190 A * 2/1999 Butler ..... 132/208
6,098,636 A * 8/2000 Curtiss et al. ..... 132/277
6,360,752 B1 * 3/2002 Chang ..... 132/277

FOREIGN PATENT DOCUMENTS

DE 296 00 643 U1 4/1996
GB 2 276 818 A 10/1994

* cited by examiner

HAIR CLIP AND METHOD FOR USING SAID HAIR CLIP

BACKGROUND OF THE INVENTION

1. Field of the Invention

The invention relates to a hairclip for securing a lock of hair wound onto a curler, where the hairclip has two legs that are connected with each other by means of a hinge with a spring, in which the legs each have a tine base connected with a number of curved clip tines arranged in a row on one side and an actuating section adjoining the tine base on the opposite side.

2. Related Art

A great variety of such hairclips are known from the prior art, for example in DE 296 00 643 U1. These hairclips are provided with centrally disposed actuating sections or actuating wings for clipping or securing them to a lock of hair wound onto a curler or also for removing them, so that (immediately) adjacent actuating sections or actuating wings make it difficult or even impossible to manually actuate the sections or wings with a thumb and index finger to clip them into place or remove them. It is also impossible to place the hairclips in close proximity to each other because the actuating sections or actuating wings interfere with one another.

SUMMARY OF THE INVENTION

The object of the invention, therefore, is to produce a hairclip of this same generic type, and a method for securing a number of curlers by means of these hairclips, which eliminate the disadvantages explained above.

This object and others which will be made more apparent hereinafter are attained in a hair clip for securing a lock of hair wound on a curler, which has two legs and a hinge with a spring connecting the two legs, the legs comprise respective tine bases, actuating sections adjoining the tine bases on one side thereof and corresponding curved tines extending from an opposite side of the tine bases, which are arranged in rows along the tine bases and curved toward each other.

According to the invention the actuating sections are arranged diametrically opposite each other along the tine bases and laterally or asymmetrically in relation to a length along the tine bases.

In preferred embodiments of the invention the hairclips can be provided in different size classes and further classified by designated colors.

In the method according to the claimed invention the hairclips according to the invention are used to provide a dense arrangement of curlers with hair wound on them secured by the hairclips and to provide easy hand manipulation of the hairclips. This method comprises placing the hairclips on the curlers so that they are oriented with the actuating sections of one hairclip not in the immediate vicinity of the actuating sections of adjacent hairclips.

BRIEF DESCRIPTION OF THE DRAWINGS

The invention will be explained in detail in conjunction with several exemplary embodiments, which are shown in the appended figures.

DETAILED DESCRIPTION OF THE INVENTION

Figure 1:
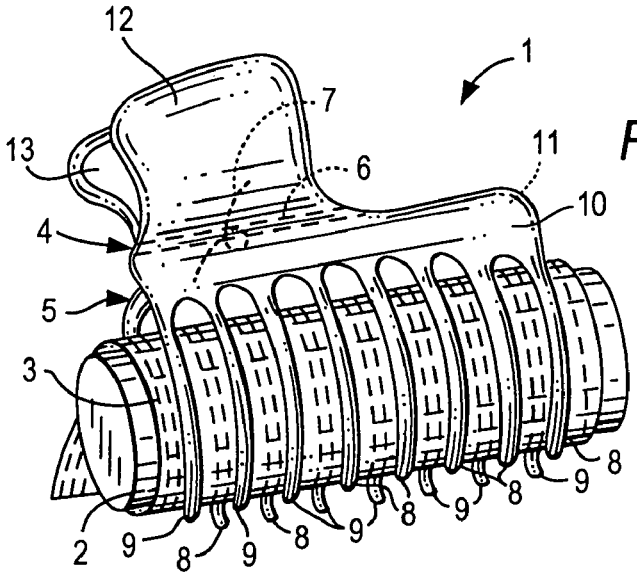
FIG. 1 is a perspective view of a first embodiment of a hairclip according to the invention for securing a lock of hair wound onto a curler.

FIG. 1 shows a hairclip 1 for securing a lock of hair 3 wound onto a curler 2. The hairclip 1 comprises two legs 4, 5, a hinge 6 connecting the two legs and a spring 7 connected between the two legs 4, 5. The legs 4, 5 each have a tine base 10, 11 connected with a number of curved tines 8, 9 arranged in a row along one side of the tine base and an actuating section 12, 13 adjoining the tine base 10, 11 on the other side. The two actuating sections 12, 13 are arranged opposite each other in the hair clip 1. Each actuating section 12, 13 adjoins tine base 10, 11 asymmetrically (at one end) in relation to the length of the tine base 10, 11, which permits unhindered operation of the actuating sections 12, 13. Each leg 4, 5 is respectively provided with at least three tines 8, 9, preferably with four or more tines 8, 9. The hairclips 1 are inexpensive to produce and are chemically durable because at least the legs 4, 5 are made of plastic. Each leg 4, 5 may be, for example, provided with four tines 8, 9.

Figure 2:
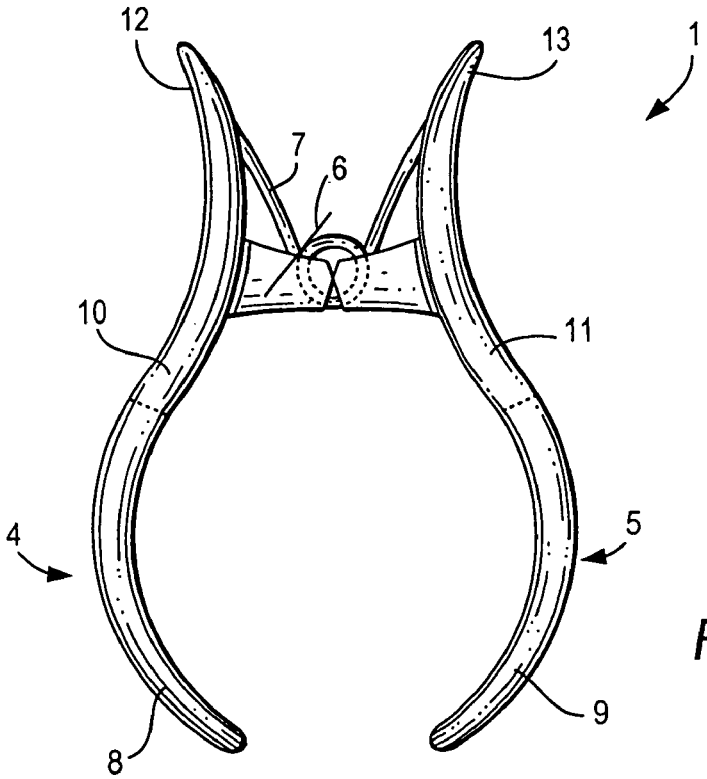
FIG. 2 is a side view of the hairclip according to FIG. 1.

The hairclip 1 according to FIG. 2 is shown in a side view without a curler 2 and shows the hairclip 1 in an intermediary position between open and closed.

Figure 3:
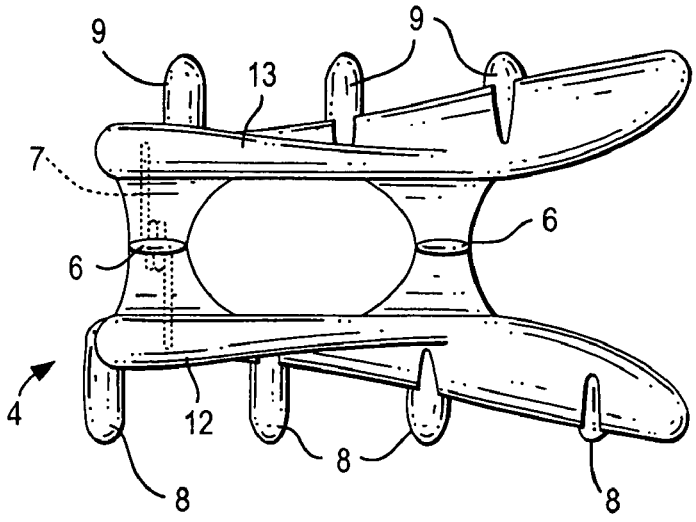
FIG. 3 is a top view of another embodiment of the hairclip.

FIG. 3 shows a top view of the hairclip 1 according to another embodiment of the invention; in particular, a two-piece hinge 6 is shown here, but this can also be embodied as one continuous hinge like that shown in FIG. 1.

Figure 4:
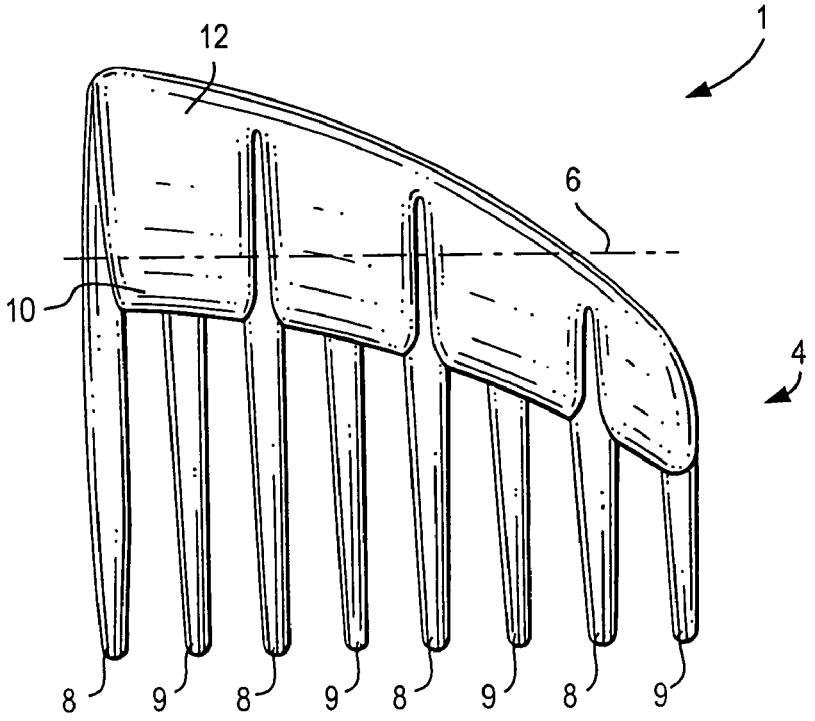
FIG. 4 is a side view of the hairclip according to FIG. 3.

As shown in particular by FIG. 4, the two actuating sections 12, 13 are embodied differently here than in FIG. 1, namely tapering in height from one end of the tine bases 10, 11 to the other.

Figure 5:
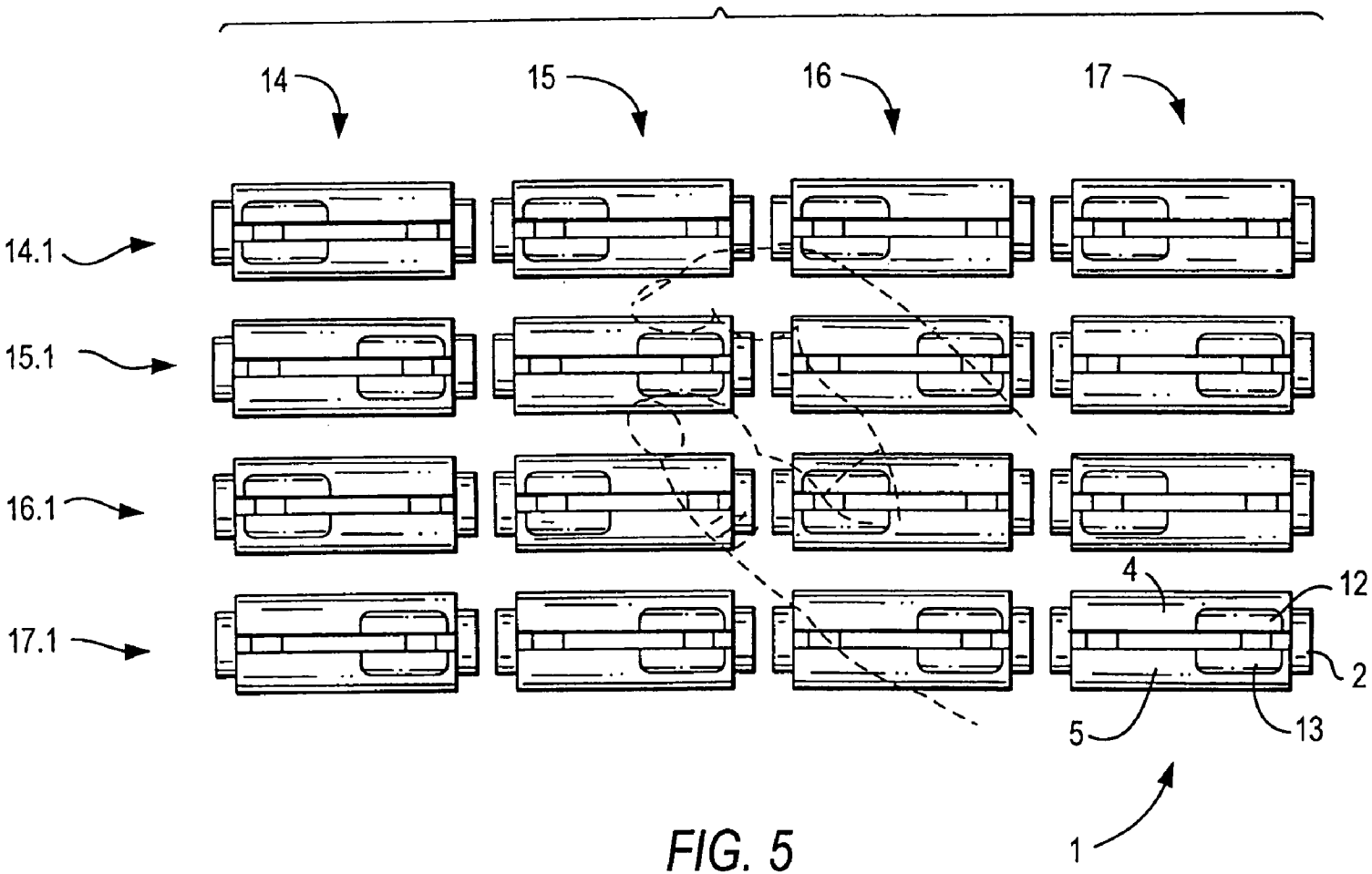
FIG. 5 is a top view of a tightly spaced array of hairclips according to the invention for securing curlers, each with a lock of hair wound onto it, according to the method of the invention.

FIG. 5 shows an arrangement of hairclips according to the invention as a result of a method for securing a number of curlers 2 by means of the hairclips 1, without the actuating sections 12, 13 interfering with one another, in which a lock of hair 3 is wound onto each curler 2 and the hairclip 1 has two laterally situated legs 4, 5, which are connected by means of a hinge 6 with a spring 7. The legs 4, 5 each have a tine base 10, 11 connected with a number of curved tines 8, 9 arranged in a row. Each tine base 10, 11 is adjoined by an actuating section 12, 13 on the opposite side from the tines 8, 9. For the sake of a tight spacing and easy manipulation of the hairclips 1, the method comprises providing hairclips 1 with asymmetrically (laterally) situated actuating leg sections 12, 13, placing the hairclips 1 on the curlers 2, so that they are oriented in such a way that the actuating sections 12, 13 of one hairclip 1 are not disposed in the immediate vicinity of the actuating sections 12, 13 of an adjacent hairclip 1. This leaves enough space between the adjacent actuating sections 12, 13 for a ha id shown with dashed lines in FIG. 5 to manually operate the actuating sections 12, 13.

As a first method example, according to FIG. 5, the hairclips 1 are placed with the curlers 2 one above the other in a vertical row 14, with an alternating orientation of the actuating sections 12, 13, and additional parallel vertical rows 15, 16, 17 are placed next to one another, with the same alternating orientation of the actuating sections 12, 13.

As a second method example, according to FIG. 5, the hairclips 1 are placed with the curlers 2 lengthwise along a horizontal row 14.1, with the same orientation of the actuating sections 12, 13, and additional horizontal rows 15.1, 16.1, 17.1 are placed above one another in alternating succession, each new row with a respectively opposite orientation of the actuating sections 12, 13.

The hairclips 1 and the method for securing a number of curlers, each with a lock of hair 3 rolled onto it, according to the invention are preferably provided for the professional hair care field. Various hairclip sizes and hairclip colors can be provided. Different size classes of the hairclips 1 are classified by means of designated colors. A one-piece embodiment of the hairclip 1 similar to DE 296 00 643 U1 can also be provided.

PARTS LIST

1 hairclip
2 curler
3 lock of hair
4 first leg
5 second leg
6 hinge
7 spring
8 first clip tines
9 second clip tines
10 first tine base
11 second tine base
12 first actuating section
13 second actuating section
14, 15, 16, 17 vertical rows
14.1, 15.1, 16.1, 17.1 horizontal rows

The invention claimed is:

1. A hair clip for securing a lock of hair wound on a curler, said hair clip comprising two legs (4,5), a hinge (6) connecting the two legs and a spring (7) connecting the two legs;

wherein said legs (4,5) comprise respective tine bases (10, 11), actuating sections (12,13) adjoining the tine bases (10,11) on one side thereof and corresponding tines (8, 9) extending from an opposite side of the tine bases, said corresponding tines being arranged in rows along the tine bases and curved toward each other; and wherein said actuating sections of said legs (4,5) are arranged diametrically opposite each other and disposed asymmetrically in relation to a length along the tine bases (10,11).

2. The hairclip according to claim 1, wherein each of said legs (4, 5) is provided with at least three tines (8, 9).

3. The hairclip according to claim 1, wherein the legs (4, 5) are made of plastic.

4. The hairclip according to claim 1, wherein the hairclip (1) is provided in different size classes.

5. The hairclip according to claim 1, wherein the hairclip (1) is provided in different color classes.

6. The hairclip according to claim 4, wherein the different size classes are further classified by designated colors.

7. A method for securing a number of curlers by means of hairclips, in which a lock of hair is wound onto each curler and the hairclip has two legs, which are connected by means of a hinge with a spring, and the legs (4,5) comprise respective tine bases (10, 11), actuating sections (12,13) adjoining the tine bases (10,11) on one side thereof and corresponding tines extending from an opposite side of the tine bases, said corresponding tines (8, 9) being arranged in rows along the tine bases and curved toward each other, characterized in that for the sake of a dense arrangement and easy hand manipulation of the hairclips (1), hairclips (1) are provided with asymmetrically or laterally situated actuating leg sections (12, 13), and the hairclips (1) placed on the curlers (2) are oriented in such a way that the actuating leg sections (12, 13) of one hairclip (1) are not disposed in the immediate vicinity of the actuating leg sections (12, 13) of an adjacent hairclip (1).

8. The method according to claim 7, wherein the hairclips (1) are placed with the curlers (2) one above the other in a row (14), with an alternating orientation of the actuating leg sections (12, 13) along the row, and additional parallel rows (15, 16, 17) are placed next to one another, with the same alternating orientation of the actuating leg sections (12, 13).

9. The method according to claim 7, wherein the hairclips (1) are placed with the curlers (2) lengthwise along a row (14.1), with the same orientation of the actuating leg sections (12, 13) alone the row, and additional rows (15.1, 16.1, 17.1) are placed above one another in alternating succession, each new row with a respectively opposite orientation of the actuating leg sections (12, 13).

* * * * *